US009785180B2

(12) United States Patent
Cheng et al.

(10) Patent No.: US 9,785,180 B2
(45) Date of Patent: Oct. 10, 2017

(54) BIAS CIRCUITRY

(71) Applicant: Qorvo US, Inc., Greensboro, NC (US)

(72) Inventors: Peng Cheng, Greensboro, NC (US); Yun Seo Koo, High Point, NC (US); Cody Hale, Browns Summit, NC (US)

(73) Assignee: Qorvo US, Inc., Greensboro, NC (US)

( * ) Notice: Subject to any disclaimer, the term of this patent is extended or adjusted under 35 U.S.C. 154(b) by 0 days.

(21) Appl. No.: 15/281,649

(22) Filed: Sep. 30, 2016

(65) Prior Publication Data

US 2017/0262008 A1 Sep. 14, 2017

Related U.S. Application Data

(60) Provisional application No. 62/306,804, filed on Mar. 11, 2016.

(51) Int. Cl.
*G05F 3/26* (2006.01)

(52) U.S. Cl.
CPC ..... *G05F 3/262* (2013.01)

(58) Field of Classification Search
CPC ..... G05F 3/10; G05F 3/16; G05F 3/20; G05F 3/24; G05F 3/26; G05F 3/262
See application file for complete search history.

(56) References Cited

U.S. PATENT DOCUMENTS

2007/0139030 A1* 6/2007 Lee ..... G05F 3/30 323/315
2012/0313712 A1* 12/2012 Larsen ..... H03F 1/305 330/297
2013/0033251 A1* 2/2013 Nagatomo ..... G05F 3/242 323/315

OTHER PUBLICATIONS

Gray, Paul R. et al., "Analysis and Design of Analog Integrated Circuits," Fourth Edition, John Wiley & Sons, Inc., Mar. 27, 2001, 889 pages.
Kobayashi, Kevin W., "Improved efficiency, IP3-Bandwidth and Robustness of a Microwave Darlington Amplifier using 0.5um ED PHEMT and a New Circuit Topology," CSIC 2005 Digest, IEEE, pp. 93-96.
Noh, Younsub et al., "Ku-Band Power Amplifier MMIC Chipset with On-Chip Active Gate Bias Circuit," ETRI Journal, vol. 31, No. 3, Jun. 2009, ETRI, pp. 247-253.
Van Wanum, M. et al., "Generic robust LVCMOS-compatible control logic for GaAs HEMT switches," Proceedings of the 1st European Microwave Integrated Circuits Conference, Sep. 2006, Manchester, UK, EuMA, pp. 83-86.

* cited by examiner

*Primary Examiner* — Gary L Laxton
(74) *Attorney, Agent, or Firm* — Withrow & Terranova, P.L.L.C.

(57) ABSTRACT

Circuitry having a reference current generator and a reference current governor is disclosed. The reference current governor includes field effect transistors (FETs) that are sized such that a governor current governs a reference current flowing through the first FET to maintain the reference current within a desired reference current range.

20 Claims, 9 Drawing Sheets

BIAS CIRCUITRY

RELATED APPLICATIONS

This application claims the benefit of provisional patent application Ser. No. 62/306,804, filed Mar. 11, 2016, the disclosure of which is hereby incorporated herein by reference in its entirety.

FIELD OF THE DISCLOSURE

The present disclosure relates to transistor biasing topologies that compensate for process deltas during manufacturing and temperature drifts during operation.

BACKGROUND

Amplifier current variations and amplifier gain variations observed in pseudomorphic high electron mobility transistor (PHEMT) technology in both enhancement mode and depletion mode operation are unsatisfactorily large for high yield production. Attempts to solve this issue have focused on threshold voltage control through enhanced epitaxial processes and process variation limits. However, such processes and techniques have not yielded any widely accepted improvements. Others have proposed transistor bias techniques at the cost of increased supply voltage sensitivities, while yet others have focused on amplifier circuit topologies that are not suitable for low-noise amplifier operation. What is needed is bias circuitry that compensates for amplifier current variations and amplifier gain variations during either or both enhancement mode and depletion mode operation.

SUMMARY

Circuitry having a reference current generator and a reference current governor is disclosed. The reference current governor includes field effect transistors (FETs) that are sized such that a governor current governs a reference current flowing through the first FET to maintain the reference current within a desired reference current range. In an exemplary embodiment, the circuitry further includes a depletion mode current governor that corrects a total current flowing to parts of the circuitry that generates bias current for an amplifier.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
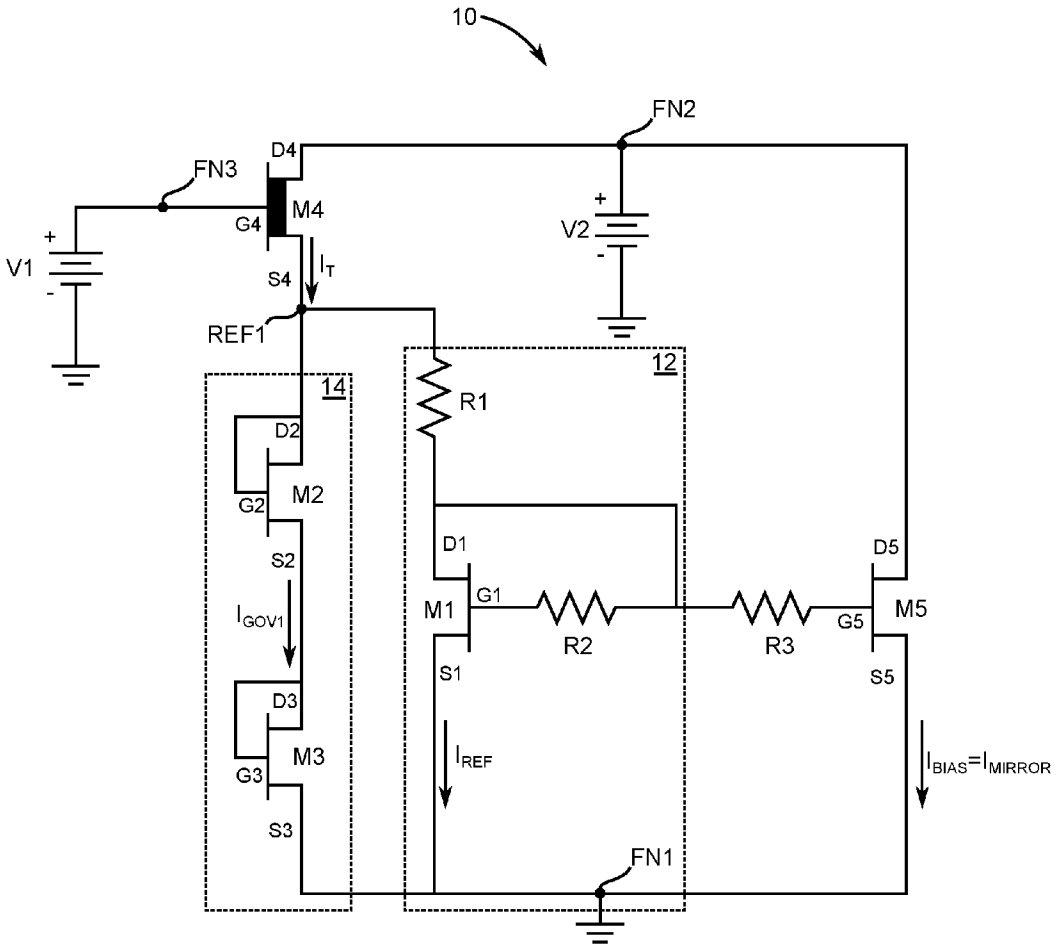
FIG. 1 is a schematic of circuitry of a first embodiment that includes a reference current generator that generates a reference current that is corrected by a reference current governor such that the reference current is maintained steady to provide a steady mirror current that is usable as an amplifier bias current.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

FIG. 1 is a schematic of circuitry 10 of a first embodiment that includes a reference current generator 12 that generates a reference current $I_{REF}$ that is corrected by a reference current governor 14 such that the reference current $I_{REF}$ is maintained steady to provide a steady mirror current $I_{MIRROR}$ that is usable as an amplifier bias current. The reference current generator 12 includes a first field effect transistor (FET) M1 having a first drain D1, a first gate G1, and a first source S1, wherein the first gate G1 is coupled to the first drain D1, and the first source S1 is coupled to a first fixed voltage node FN1. In the exemplary embodiments of the present disclosure the first fixed voltage node FN1 is at ground potential. A reference resistor R1 is coupled between the first drain D1 and a reference node REF1.

The reference current governor 14 includes a second FET M2 having a second drain D2, a second gate G2, and a second source S2, wherein the second drain D2 is coupled to the reference node REF1 and the second gate G2 is coupled to the second drain D2. Also included in the reference current governor 14 is a third FET M3 having a third drain D3, a third gate G3, and a third source S3, wherein the third drain D3 is coupled to the second source S2, the third gate G3 is coupled to the third drain D3, and the third source S3 is coupled to the first fixed voltage node FN1. A governor current $I_{GOV1}$ flows through the second FET M2 and the third FET M3. The second FET M2 and the third FET M3 are sized such that the governor current $I_{GOV1}$ governs the reference current $I_{REF}$ flowing through the first FET M1 to maintain the reference current $I_{REF}$ within a desired reference current range. An exemplary desired range is within ±2.75% of a given reference current value. For example, the desired reference current range for a given reference current value of 1.95 mA is between 1.9 mA and 2.0 mA.

In the exemplary embodiment of FIG. 1, the first FET M1, the second FET M2, and the third FET M3 are enhancement mode FETs. Moreover, the circuitry 10 further includes a fourth FET M4 having a fourth drain D4 coupled to a second fixed voltage node FN2, a fourth source S4 coupled to the reference node REF1, and a fourth gate G4 coupled to a third fixed voltage node FN3, wherein the fourth FET M4 is a depletion mode FET through which a total current $I_T$ that includes the reference current $I_{REF}$ and the governor $I_{GOV}$ current flows.

The circuitry 10 also further includes a fifth FET M5 having a fifth drain D5 coupled to the second fixed voltage node FN2, a fifth source S5 coupled to the first fixed voltage node FN1, and a fifth gate G5 coupled to the first gate G1 of the first FET M1. The circuitry 10 further includes further a second resistor R2 that is coupled between the first drain D1 and the first gate G1 of the first FET M1, and a third resistor R3 that is coupled between the first drain D1 of the first FET M1 and the fifth gate G5 of the fifth FET M5. The second resistor R2 and the third resistor R3 serve as a beta helper that decreases the dependence upon gain to achieve accurate current mirroring.

In this exemplary embodiment the first FET M1 and the fifth FET M5 are in a current mirror configuration that proportionally duplicates the reference current $I_{REF}$ to realize the mirror current $I_{MIRROR}$ that flows through the fifth FET M5. The mirror current IREF is used as a bias current for the fifth FET M5 that is employed as an amplifier for RF signals.

Figure 2:
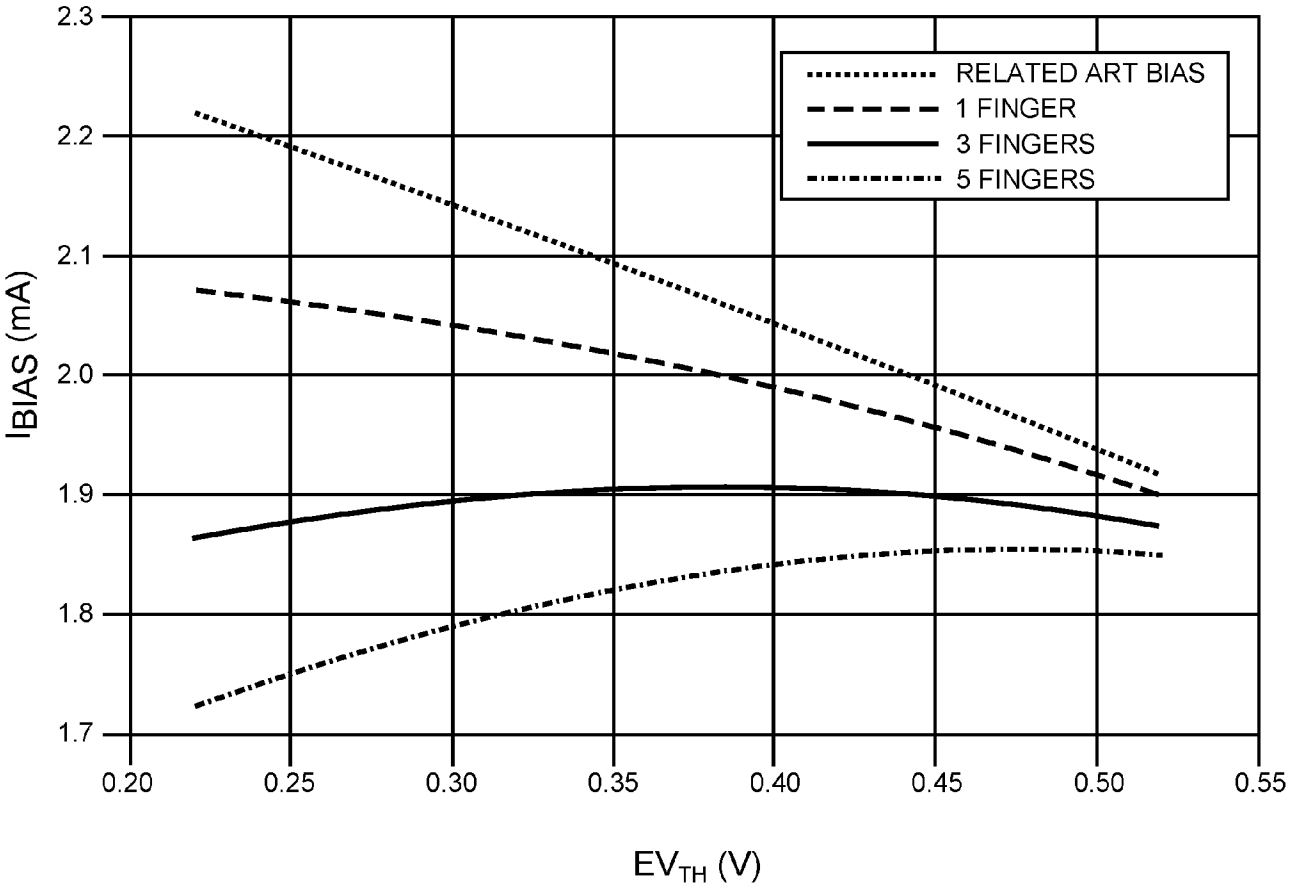
FIG. 2 is a graph of current versus threshold voltage for the enhancement mode field effect transistors (E-FETs) comprising a current mirror.

FIG. 2 is a graph of current versus threshold voltage for the first FET M1 and the fifth FET M5, which are enhancement mode field effect transistors (E-FETs) comprising the current mirror configuration. As shown in FIG. 2, a related art bias circuitry without the benefit of the reference current governor 14 produces a bias current represented in short dashed line. The related art bias circuitry suffers a relatively large change in bias current for a given change in enhancement mode threshold voltage $EV_{TH}$. In contrast, as represented in long dashed line, current flowing through the first FET M1 and the second FET M5 benefit from reference current compensation provided by the reference current governor 14. In this case, the first FET M1 and the fifth FET M5 each only have one finger.

Even more bias current stability versus $EV_{TH}$ is realized by including three fingers in each of the first FET M1 and the fifth FET M5. The improvement in bias current is depicted in solid line. However, in this exemplary case, adding more fingers to each of the first FET M1 and the second FET M5 does not necessarily improve bias current stability any further versus $EV_{TH}$ as shown in dotted and dashed line.

Figure 3:
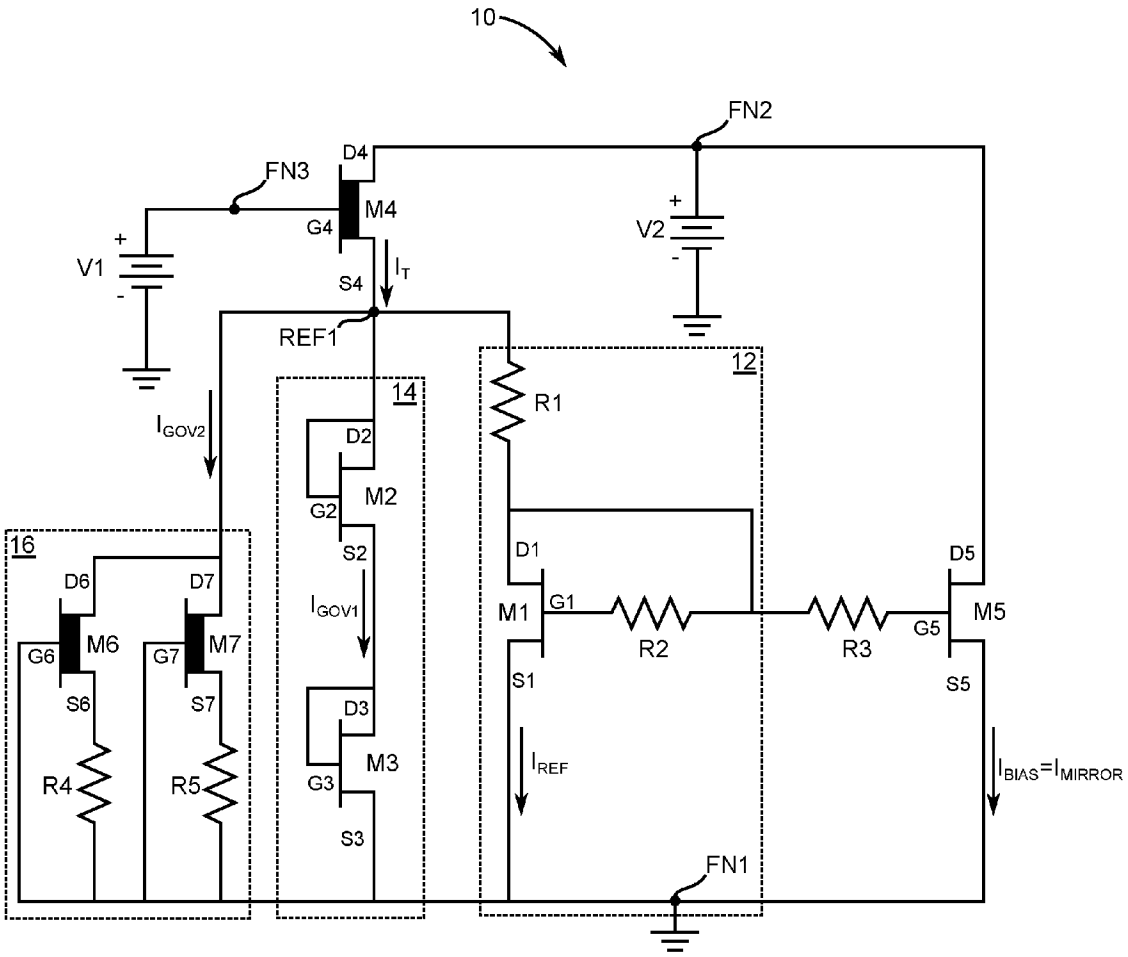
FIG. 3 is a schematic of the circuitry further including a depletion mode current governor that corrects a total current flowing to parts of the circuitry that generates bias current for an amplifier.

FIG. 3 is a schematic of the circuitry 10 further including a depletion mode current governor 16 that corrects a total current $I_T$ flowing to parts of the circuitry 10 that generate bias current for the fifth FET M5 by generating a second governor current $I_{GOV2}$. The depletion mode current governor 16 includes a sixth FET M6 having a sixth drain D6 coupled to the reference node REF1, a sixth gate G6 coupled to the first fixed voltage node FN1, and sixth source S6 coupled to the first fixed voltage node FN1 through a first source resistor R4. Further included is a seventh FET M7 having a seventh drain D7 coupled to the reference node REF1, a seventh gate G7 coupled to the first fixed voltage node FN1, and a seventh source S7 coupled to the first fixed voltage node FN1 through a second source resistor R5, wherein the sixth FET M6 and the seventh FET M7 are sized such that the total current $I_T$ that flows through the fourth FET M4 maintains within a desired total current range. An exemplary desired range is within ±2.75% of a given total current value.

Figure 4:
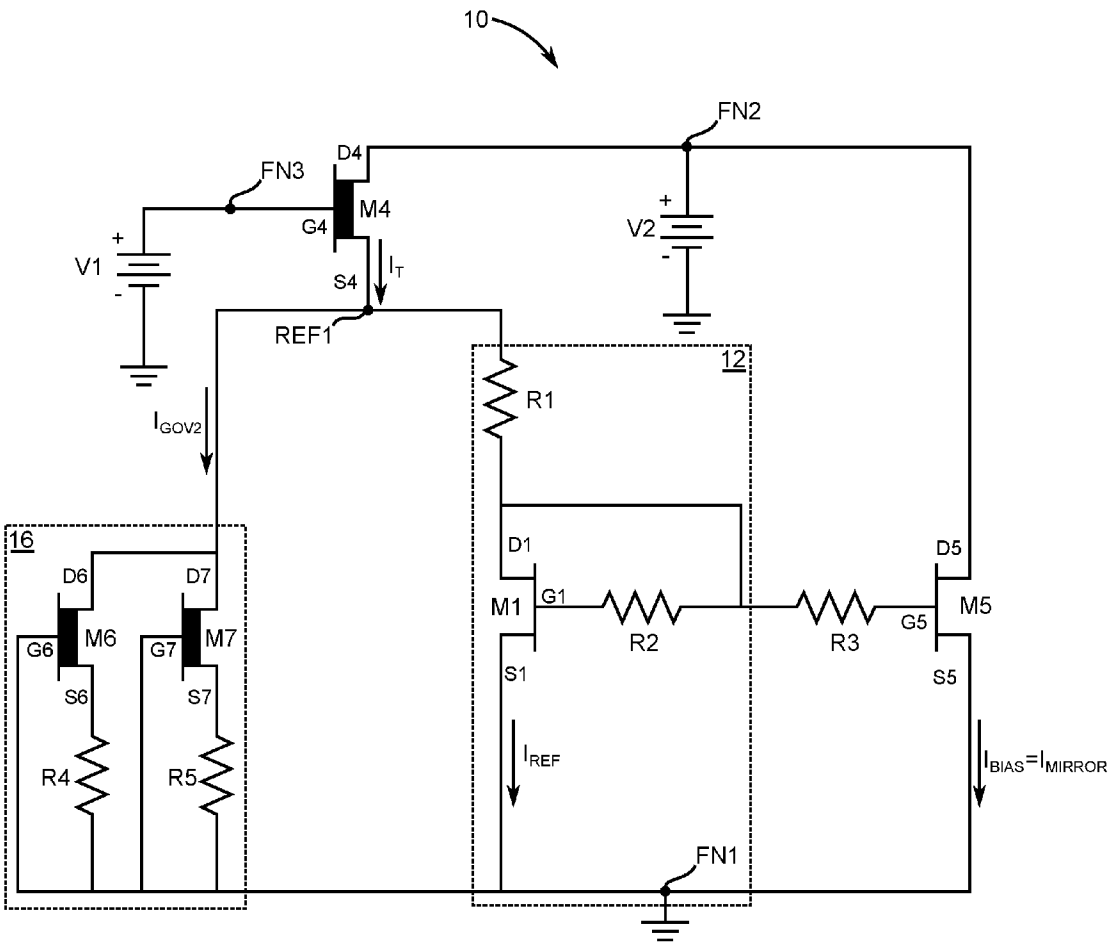
FIG. 4 is a schematic of the circuitry that includes the depletion mode current governor, but does not include the reference current governor.
Figure 5:
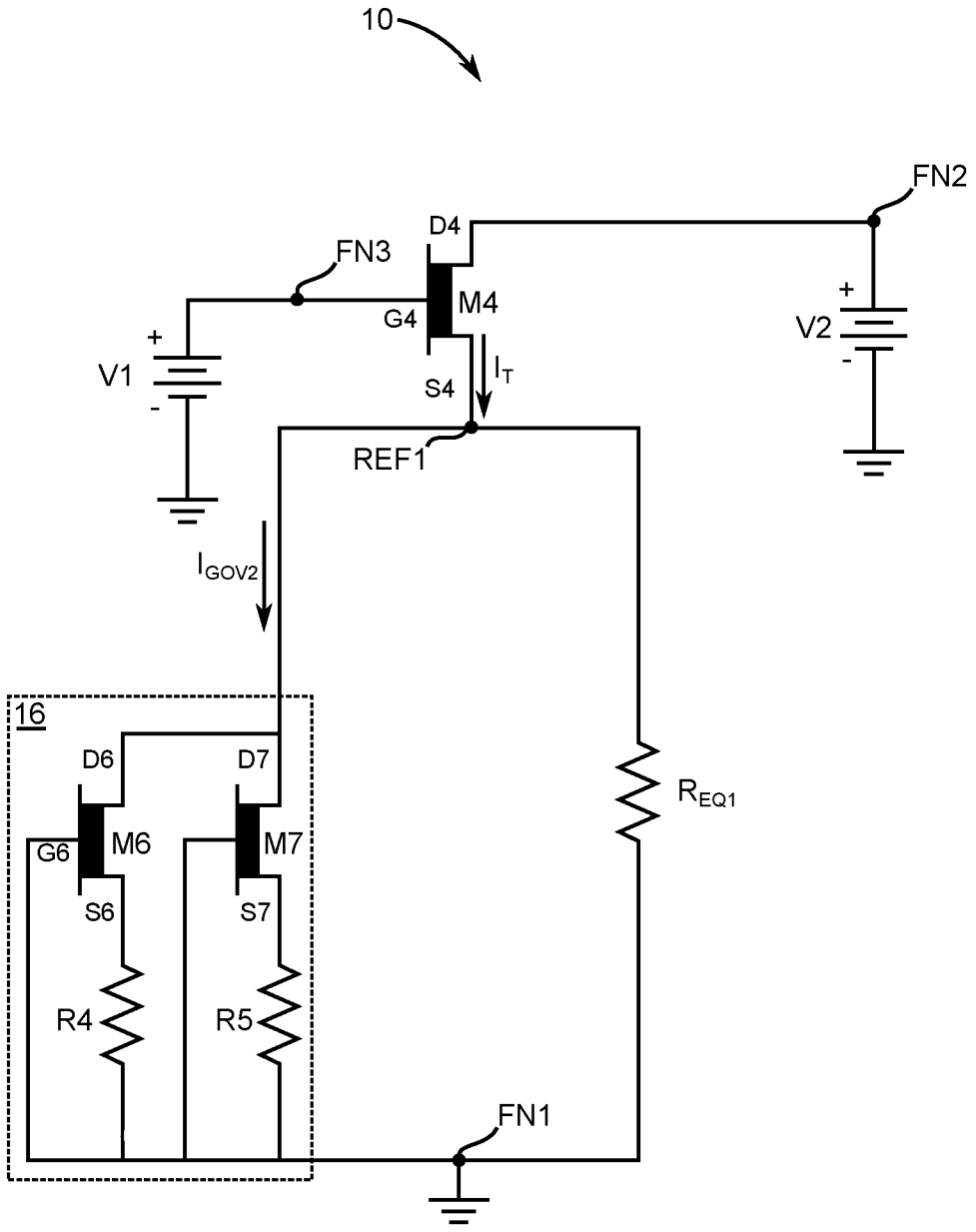
FIG. 5 is a schematic of equivalent circuitry for the circuitry of FIG. 4.

FIG. 4 is a schematic of the circuitry 10 that includes the depletion mode current governor 16, but does not include the reference current governor 14. In the exemplary embodiments, the sixth FET M6 and the seventh FET M7 are depletion mode FETS. FIG. 5 is a schematic of equivalent circuitry for the circuitry of FIG. 4. In this case, an equivalent resistor $R_{EQ1}$ can replace the first resistor R1 and the current mirror configuration of the first FET M1 and the fifth FET M5 in order to determine sizes for the sixth FET M6 and the seventh FET M7 that maximize stability of the total current $I_T$. In the exemplary embodiments depicted in FIGS. 1, 3, 4, and 5, the first fixed voltage node FN1 is at ground potential, the second fixed voltage node FN2 is at a first voltage level between about 3.6V and 3.0V, and the third fixed voltage node FN3 is at a second voltage level between about 1.5V and about 1.8V.

Figure 6:
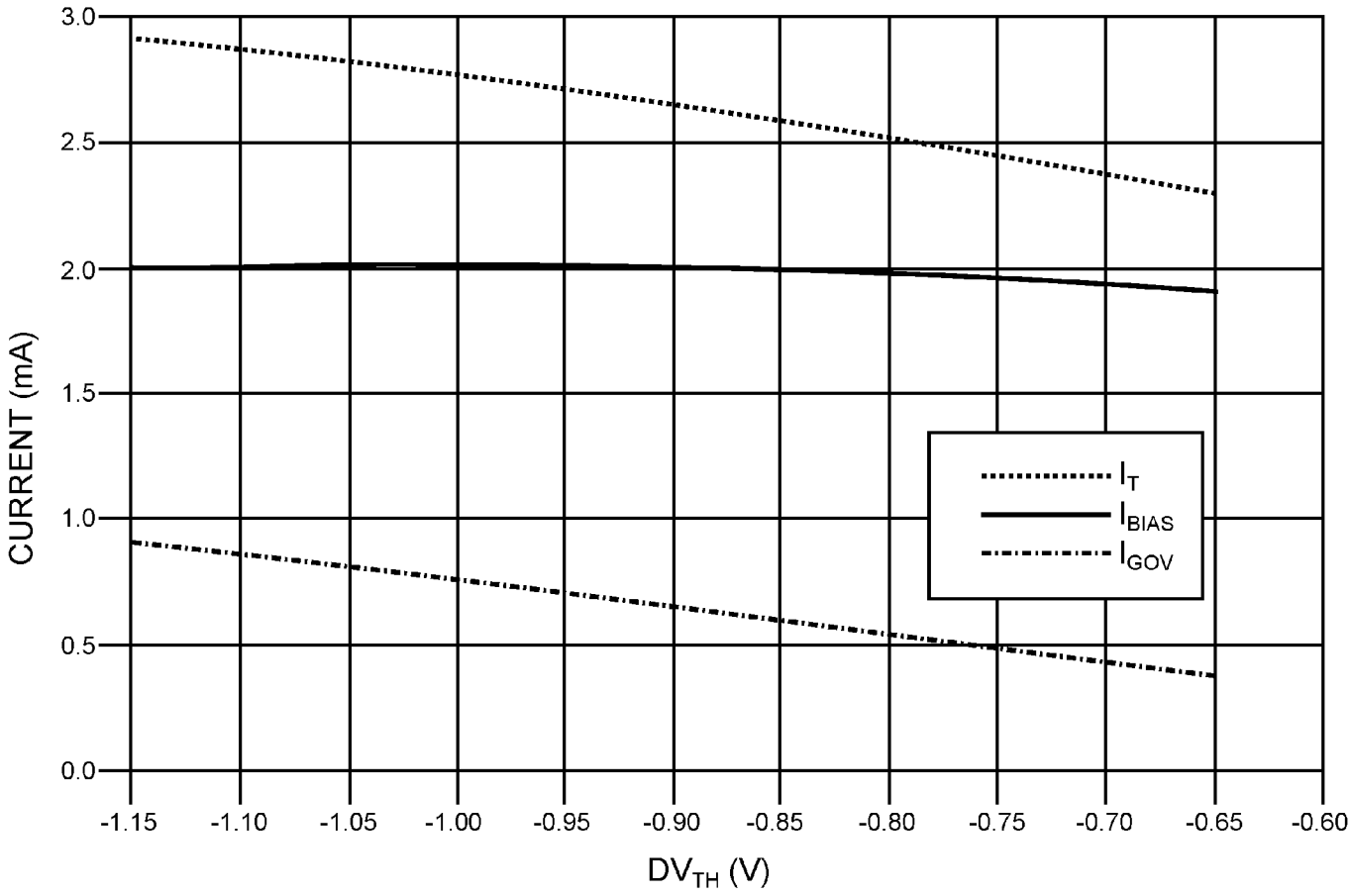
FIG. 6 is a graph of bias current versus threshold voltage for a depletion mode field effect (D-FET) that provides the total current corrected by the depletion mode current governor.

FIG. 6 is a graph of current versus depletion mode threshold voltage $DV_{TH}$ for a depletion mode field effect transistor (D-FET) such as the sixth FET M6 and the seventh FET M7 that corrects the total current $I_T$. In this case, the governor current $I_{GOV1}$ shown in dotted and dashed line balances against changes in the total current $I_T$ such that the bias current $I_{BIAS}$ remains relatively stable versus $DV_{TH}$.

Figure 7:
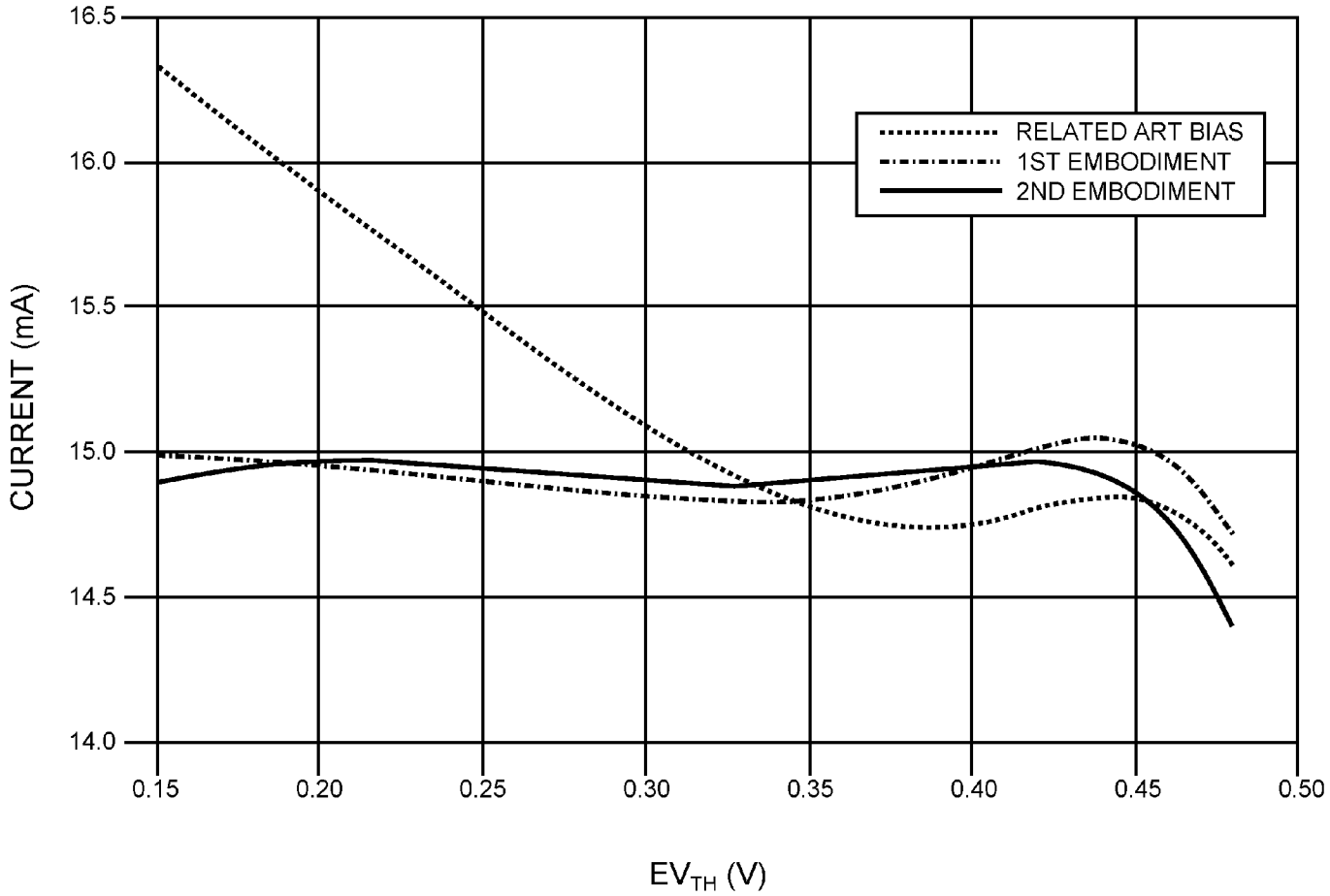
FIG. 7 is a graph of bias current versus E-FET threshold voltage for a related art bias circuitry, a first embodiment of the presently disclosed circuitry, and a second embodiment of the presently disclosed circuitry.

FIG. 7 is a graph of bias current versus E-FET threshold voltage $EV_{TH}$ for related art bias circuitry that is similar to the first embodiment of FIG. 1 minus the reference current governor 14, the first embodiment depicted in FIG. 1, and the second embodiment depicted in FIG. 3. Notice that the first embodiment and the second embodiment show a much reduced variation in current versus changes in $EV_{TH}$ in comparison to the related art bias circuitry.

Figure 8:
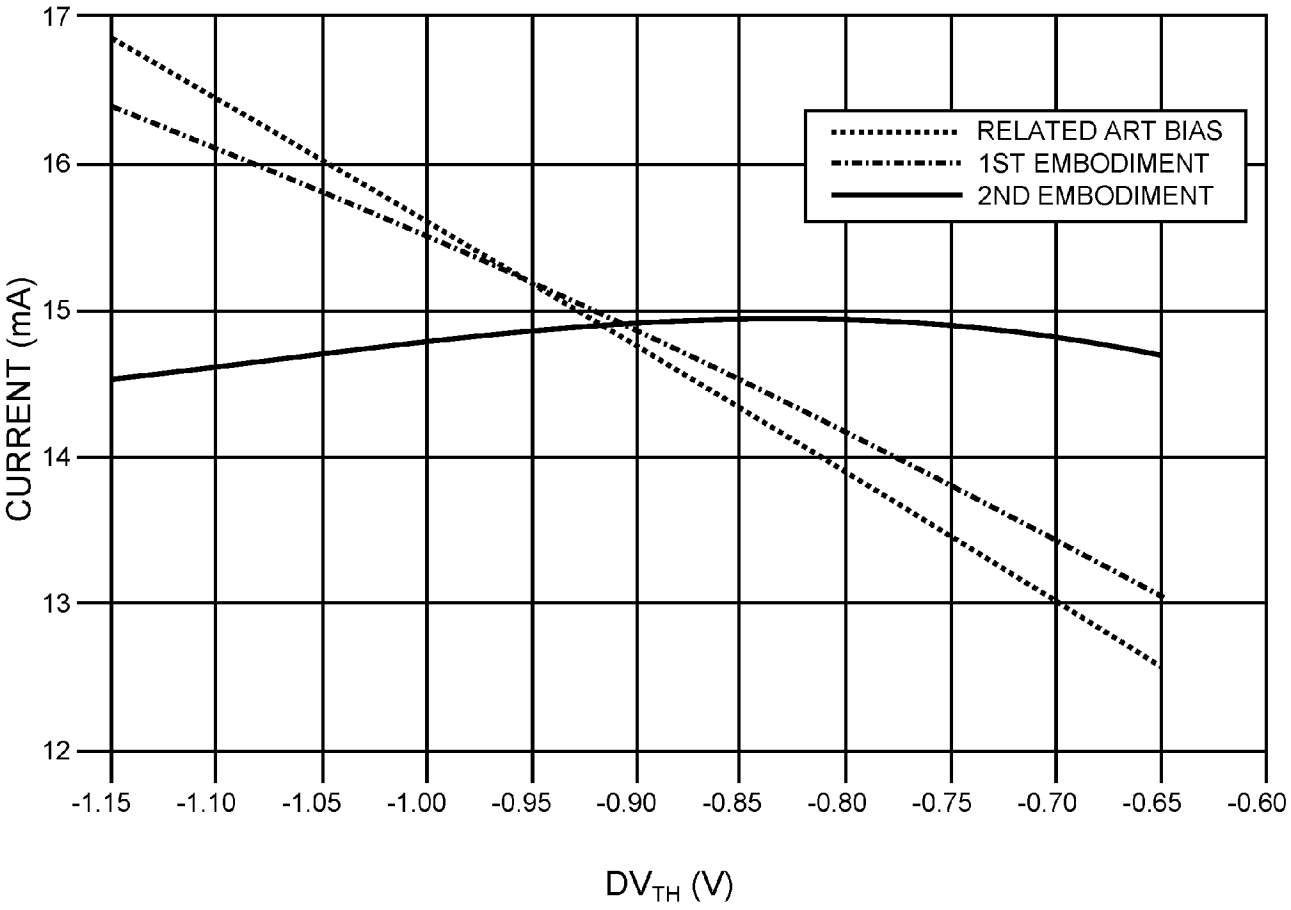
FIG. 8 is a graph of bias current versus D-FET threshold voltage for the related art bias circuitry, the first embodiment of the presently disclosed circuitry, and the second embodiment of the presently disclosed circuitry.

FIG. 8 is a graph of bias current versus D-FET threshold voltage $DV_{TH}$ for a related art bias circuitry that is similar to the first embodiment of FIG. 1 minus the reference current governor 14, the first embodiment depicted in FIG. 1, and the second embodiment depicted in FIG. 3. Notice that the currents provided by both the related art bias circuitry and the first embodiment depicted in FIG. 1 each have a strong dependence on $DV_{TH}$ in comparison to the second embodiment depicted in FIG. 3. In this particular case, the second embodiment has superior performance over the first embodiment because the second embodiment employs both the reference current governor 14 and the depletion mode current governor 16 to compensate for changes in both $EV_{TH}$ and $DV_{TH}$. The first embodiment only compensates for changes in $EV_{TH}$. However, the first embodiment has an advantage of being less complex with a reduced parts count. Thus, in situations in which changes in $DV_{TH}$ are expected to be limited, the first embodiment may be preferable over the second embodiment.

Figure 9:
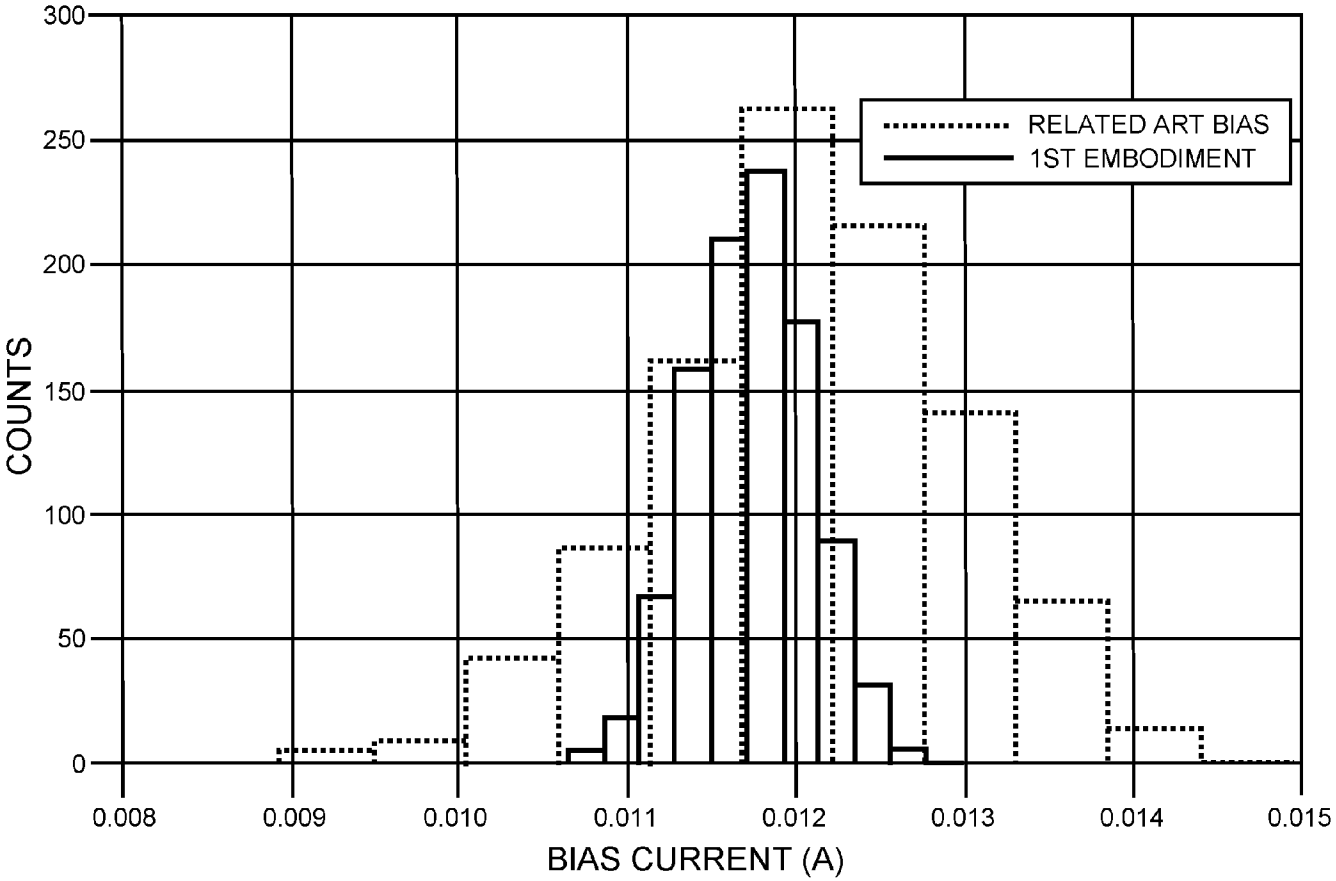
FIG. 9 is a histogram plot for a Monte Carlo simulation of the first embodiment that illustrates a significant reduction in bias current variation.

FIG. 9 is a histogram plot for a Monte Carlo simulation of related art circuitry versus a Monte Carlo simulation of the first embodiment depicted in FIG. 1. A result of the Monte Carlo simulation for the related art bias circuitry having the same structure as the first embodiment minus the reference current governor 14 is shown in dashed line. A result of the Monte Carlo simulation for the first embodiment having the reference current governor 14 is depicted in solid line. Notice that deviations in the bias current are substantially reduced for the first embodiment relative to the related art bias that does not include the reference current governor 14.

Those skilled in the art will recognize improvements and modifications to the preferred embodiments of the present disclosure. All such improvements and modifications are considered within the scope of the concepts disclosed herein and the claims that follow.

What is claimed is:

1. Circuitry comprising:

a reference current generator comprising:

a first field effect transistor (FET) having a first drain, a first gate, and a first source, wherein the first gate is coupled to the first drain, and the first source is coupled to a first fixed voltage node; and a reference resistor coupled between the first drain and a reference node; and a reference current governor comprising:

a second FET having a second drain, a second gate, and a second source, wherein the second drain is coupled to the reference node and the second gate is coupled to the second drain; and a third FET having a third drain, a third gate, and a third source, wherein:

the third drain is coupled to the second source, the third gate is coupled to the third drain, the third source is coupled to the first fixed voltage node, and a governor current flows through the second FET and the third FET; and the second FET and the third FET are sized such that the governor current governs a reference current flowing through the first FET to maintain the reference current within a desired reference current range.

2. The circuitry of claim 1 wherein the first FET, the second FET, and the third FET are enhancement mode FETs.

3. The circuitry of claim 2 further including a fourth FET having a fourth drain coupled to a second fixed voltage node, a fourth source coupled to the reference node, and a fourth gate coupled to a third fixed voltage node, wherein the fourth FET is a depletion mode FET through which a total current that includes the reference current and the governor current flows.

4. The circuitry of claim 3 further including a fifth FET having a fifth drain coupled to the second fixed voltage node, a fifth source coupled to the first fixed voltage node, and a fifth gate coupled to the first gate of the first FET.

5. The circuitry of claim 4 wherein the reference current is proportionally duplicated as a mirror current that flows through the fifth FET.

6. The circuitry of claim 4 further including a resistor that is coupled between the first drain and the first gate of the first FET, and a third resistor that is coupled between the first drain of the first FET and the fifth gate of the fifth FET.

7. The circuitry of claim 4 further including a depletion mode current governor comprising:

a sixth FET having a sixth drain coupled to the reference node, a sixth gate coupled to the first fixed voltage node, and a sixth source coupled to the first fixed voltage node through a first source resistor; and a seventh FET having a seventh drain coupled to the reference node, a seventh gate coupled to the first fixed voltage node, and a seventh source coupled to the first fixed voltage node through a second source resistor, wherein the sixth FET and the seventh FET are sized such that the total current that flows through the fourth FET maintains within a desired total current range.

8. The circuitry of claim 7 wherein the first fixed voltage node is ground, the second fixed voltage node is at a first voltage level between about 3.6V and 3.0V, and the third fixed voltage node is at a second voltage level between about 1.5V and about 1.8V.

9. The circuitry of claim 4 wherein the sixth FET and the seventh FET are depletion mode FETS.

10. The circuitry of claim 7 wherein the governor current decreases as threshold voltage of the first FET increases, and wherein the total current decreases as the threshold voltage of the fourth FET increases.

11. Circuitry comprising:

a first FET having a first drain coupled to a first fixed voltage node, a first source coupled to a reference node, and a first gate coupled to a second fixed voltage node, wherein the first FET is a depletion mode FET through which a total current flows; and a depletion mode current governor comprising:

a second FET having a second drain coupled to the reference node, a second gate coupled to a third fixed voltage node, and a second source coupled to the third fixed voltage node through a first source resistor; and a third FET having a third drain coupled to the reference node, a third gate coupled to the third fixed voltage node, and a third source coupled to the third fixed voltage node through a second source resistor, wherein the second FET and the third FET are sized such that the total current that flows through the first FET maintains within a desired total current range.

12. The circuitry of claim 11 wherein the second FET and the third FET are depletion mode FETs.

13. The circuitry of claim 11 further comprises:

a reference current generator comprising:

a fourth FET having a fourth drain, a fourth gate, and a fourth source, wherein the fourth gate is coupled to the fourth drain, and the fourth source is coupled to the third fixed voltage node; and a reference resistor coupled between the fourth drain and a reference node; and a reference current governor comprising:

a fifth FET having a fifth drain, a fifth gate, and a fifth source, wherein the fifth drain is coupled to the reference node, the fifth gate is coupled to the fifth drain; and a sixth FET having a sixth drain, a sixth gate, and a sixth source, wherein;

the sixth drain is coupled to the fifth source, the sixth gate is coupled to the sixth drain, the sixth source is coupled to the sixth fixed voltage node, and a governor current flows through the fifth FET and the sixth FET; and the fifth FET and the sixth FET are sized such that the governor current governs a reference current flowing through the fourth FET to maintain the reference current within a desired reference current range.

14. The circuitry of claim 13 wherein the fourth FET, the fifth FET, and the sixth FET are enhancement mode FETs.

15. The circuitry of claim 13 further including a seventh FET having a seventh drain coupled to the first fixed voltage node, a seventh source coupled to the third fixed voltage node, and a seventh gate coupled to the fourth gate of the fourth FET.

16. The circuitry of claim 15 wherein the reference current is proportionally duplicated as a mirror current that flows through the seventh FET.

17. The circuitry of claim 15 further including a resistor that is coupled between the fourth drain and the fourth gate of the fourth FET, and a third resistor that is coupled between the fourth drain of the fourth FET and the seventh gate of the seventh FET.

18. The circuitry of claim 15 wherein the third fixed voltage node is ground, the second fixed voltage node is at a first voltage level between about 3.6V and 3.0V, and the second fixed voltage node is at a second voltage level between about 1.5V and about 1.8V.

19. The circuitry of claim 13 wherein the total current decreases as threshold voltage of the first FET increases, and wherein the governor current decreases as the threshold voltage of the fourth FET increases.

20. The circuitry of claim 13 wherein the total current increases as threshold voltage of the first FET decreases, and wherein the governor current increases as the threshold voltage of the fourth FET decreases.

* * * * *